US006607448B2

(12) United States Patent
Moore

(10) Patent No.: US 6,607,448 B2
(45) Date of Patent: Aug. 19, 2003

(54) ELEVATED GOLF PUTTING PRACTICE DEVICE

(76) Inventor: Alexander Moore, Les Sablons, Golf Lane, Groville, Jersey JE3 9BD (GB)

( * ) Notice: Subject to any disclaimer, the term of this patent is extended or adjusted under 35 U.S.C. 154(b) by 0 days.

(21) Appl. No.: 10/007,857

(22) Filed: Nov. 5, 2001

(65) Prior Publication Data

US 2002/0082100 A1 Jun. 27, 2002

Related U.S. Application Data

(63) Continuation of application No. 09/256,801, filed on Feb. 24, 1999, now abandoned.

(51) Int. Cl.[7] ..... A63B 67/02
(52) U.S. Cl. ..... 473/160
(58) Field of Search ..... 473/157–164, 473/181

(56) References Cited

U.S. PATENT DOCUMENTS

| | | | | |
|---|---|---|---|---|
| 1,614,704 A | | 1/1927 | Woodin et al. | |
| 1,689,476 A | | 10/1928 | Brumder | |
| 1,759,156 A | | 5/1930 | Fish | |
| 2,110,925 A | | 3/1938 | Trangmar | |
| 2,144,439 A | | 1/1939 | Duffy | |
| 2,456,813 A | | 12/1948 | Cavins | |
| 3,275,325 A | | 9/1966 | MacKenzie | |
| 3,351,345 A | | 11/1967 | Robinette | |
| 3,549,151 A | | 12/1970 | Long | |
| 3,558,139 A | | 1/1971 | Brandell | |
| 3,843,136 A | | 10/1974 | Buenzle | |
| 3,856,313 A | | 12/1974 | Tierney | |
| 4,563,009 A | | 1/1986 | Nagasaki et al. | |
| 4,906,006 A | | 3/1990 | Sigunick | |
| D311,216 S | | 10/1990 | Simjian | |
| 5,082,280 A | | 1/1992 | Wang | |
| 5,102,141 A | | 4/1992 | Jordan | |
| 5,139,262 A | | 8/1992 | Lai | |
| 5,431,403 A | | 7/1995 | Pelz | |
| 5,441,266 A | * | 8/1995 | Cedrone | 473/160 |
| 5,524,891 A | | 6/1996 | Owen, Jr. et al. | |
| 5,573,247 A | | 11/1996 | Ridge | |
| 6,062,984 A | | 5/2000 | Ju | |

FOREIGN PATENT DOCUMENTS

| | | |
|---|---|---|
| GB | 220377 | 8/1924 |
| GB | 954730 | 4/1964 |
| GB | 1017200 | 1/1966 |
| GB | 1073847 | 6/1967 |
| GB | 2 127 257 | 12/1972 |
| GB | 2 147 814 A | 5/1985 |

* cited by examiner

*Primary Examiner*—Mark S. Graham

(57) ABSTRACT

A golf putting practice device is provided including a base with a substantially planar rectangular configuration defined by a short bottom edge and a pair of elongated side edges and a top edge. Also included is a target situated on the base adjacent to the top edge thereof. Next provided is a peripheral lip coupled to the top edge and side edges of the base and extending upwardly therefrom. Coupled to the base and depending downwardly therefrom is a leg for supporting the base at an angle.

3 Claims, 6 Drawing Sheets

ELEVATED GOLF PUTTING PRACTICE DEVICE

CROSS REFERENCE TO RELATED APPLICATION

This application is a continuation of application Ser. No. 09/256,801, filed Feb. 24, 1999, abandoned.

Related Applications

The present application is based on a plurality of applications filed in the United Kingdom. Such applications include GB 9803863.1 filed Feb. 24, 1998, GB 9807285.3 filed Apr. 6, 1998, and GB 9821680.7 filed Oct. 6, 1998 which are all incorporated herein by reference.

BACKGROUND OF THE INVENTION

1. Field of the Invention

The present invention relates to golf putting practice device and more particularly pertains to a new elevated golf putting practice device for practicing putting a golf ball.

2. Description of the Prior Art

The use of golf putting practice device is known in the prior art. More specifically, golf putting practice device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,856,313; U.S. Pat. No. 2,110,925; U.S. Pat. No. 5,102,141; U.S. Pat. No. Des. 311,216; U.S. Pat. No. 4,563,009; and U.S. Pat. No. 1,749,156.

Known devices for putting practice include the EASY PUTT™. Such a device is battery operated and includes a target area having a sensor. The person practicing their putting aims a ball at the target area of the EASY PUTT and the sensor detects when a ball hits the sensor. Such a known putting device also includes a stop means, such as a recess, which holds the ball in the recess in a fixed position, once it hits the sensor area. The ball is then ejected from the Easy Putt by an ejecting mechanism.

Also known is a device called a stimp meter, which is not a putting aid and is used solely to measure the speed of a golf putting green. A stimp meter is a narrow channeled, inclined surface which is approximately 100 cms in length and not more than approximately 5 cms in width. A ball is placed in a recess at an end of the stimp meter and that end of the stimp meter is then raised, relative to an end of the stimp meter which is resting on a putting green, to a height of approximately 27 cms above the putting surface. When more than 50% of ball passes over its center of gravity, the ball over-balances and rolls down the slope and the distance the ball rolls from the stimp meter along a surface is the stimp reading. The average of two stimp readings, taken from two opposite directions on the green, gives the speed of the putting green. A stimp meter, unlike the device of the present invention, has a front face of approximately 1 cms in depth which would prevent a ball from mounting the inclined surface of the stimp meter. In addition, the stimp meter is far too narrow for a person to aim a ball so as to travel along the stimp meter.

In these respects, the elevated golf putting practice device according to the present invention substantially departs from the conventional concepts and designs of the prior art, and in so doing provides an apparatus primarily developed for the purpose of practicing putting a golf ball.

SUMMARY OF THE INVENTION

In view of the foregoing disadvantages inherent in the known types of golf putting practice device now present in the prior art, the present invention provides a new elevated golf putting practice device construction wherein the same can be utilized for practicing putting a golf ball.

The general purpose of the present invention, which will be described subsequently in greater detail, is to provide a new elevated golf putting practice device apparatus and method which has many of the advantages of the golf putting practice device mentioned heretofore and many novel features that result in a new elevated golf putting practice device which is not anticipated, rendered obvious, suggested, or even implied by any of the prior art golf putting practice device, either alone or in any combination thereof.

To attain this, the present invention generally comprises a base having a bottom portion with a substantially planar rectangular configuration defined by a short linear bottom edge and a pair of elongated linear side edges. The base further includes a top portion with a substantially planar rectangular configuration defined by a short semicircular top edge, a pair of elongated side edges, and a short linear bottom edge. Such bottom edge of the top portion is integrally coupled to a short linear top edge of the bottom portion and resides in a plane which forms an obtuse angle with respect to that in which the bottom portion resides. In the alternative, the top portion and the bottom portion may reside in coplanar relationship. Situated on the top portion of the base is a circular target. Lining an entire surface of the top portion and the bottom portion of the base is a felt material. Further, a peripheral lip is coupled to the top edge and side edges of the top portion of the base and extends upwardly therefrom. Finally, a leg is equipped with a substantially planar configuration defined by a linear top edge coupled between the side edges of the top portion of the base at a midpoint thereof and in perpendicular relationship therewith. As shown in FIG. 3, the leg is further defined by a pair of linear side edges and a semicircular bottom edge to define a pair of pointed feet for abutting a ground surface In use, the leg resides within a plane which forms about a 45 degree angle with a plane in which the top portion of the base resides. Note FIG. 2.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

The aim of the present invention is to provide an easily transportable device which can be used to practice the aiming and strength of propelling/hitting of a ball. In particular, the invention provides a device which enables a player to improve his or her skills in aiming a ball by providing a clear target area.

It is therefore an object of the present invention to provide a new elevated golf putting practice device apparatus and method which has many of the advantages of the golf putting practice device mentioned heretofore and many novel features that result in a new elevated golf putting practice device which is not anticipated, rendered obvious, suggested, or even implied by any of the prior art golf putting practice device, either alone or in any combination thereof.

It is another object of the present invention to provide a new elevated golf putting practice device which may be easily and efficiently manufactured and marketed.

It is a further object of the present invention to provide a new elevated golf putting practice device which is of a durable and reliable construction.

An even further object of the present invention is to provide a new elevated golf putting practice device which is susceptible of a low cost of manufacture with regard to both materials and labor, and which accordingly is then susceptible of low prices of sale to the consuming public, thereby making such elevated golf putting practice device economically available to the buying public.

Still yet another object of the present invention is to provide a new elevated golf putting practice device which provides in the apparatuses and methods of the prior art some of the advantages thereof, while simultaneously overcoming some of the disadvantages normally associated therewith.

Still another object of the present invention is to provide a new elevated golf putting practice device for practicing putting a golf ball.

Even still another object of the present invention is to provide a new elevated golf putting practice device that includes a base with a substantially planar rectangular configuration defined by a short bottom edge and a pair of elongated side edges and a top edge. Also included is a target situated on the base adjacent to the top edge thereof. Next provided is a peripheral lip coupled to the top edge and side edges of the base and extending upwardly therefrom. Coupled to the base and depending downwardly therefrom is a leg for supporting the base at an angle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
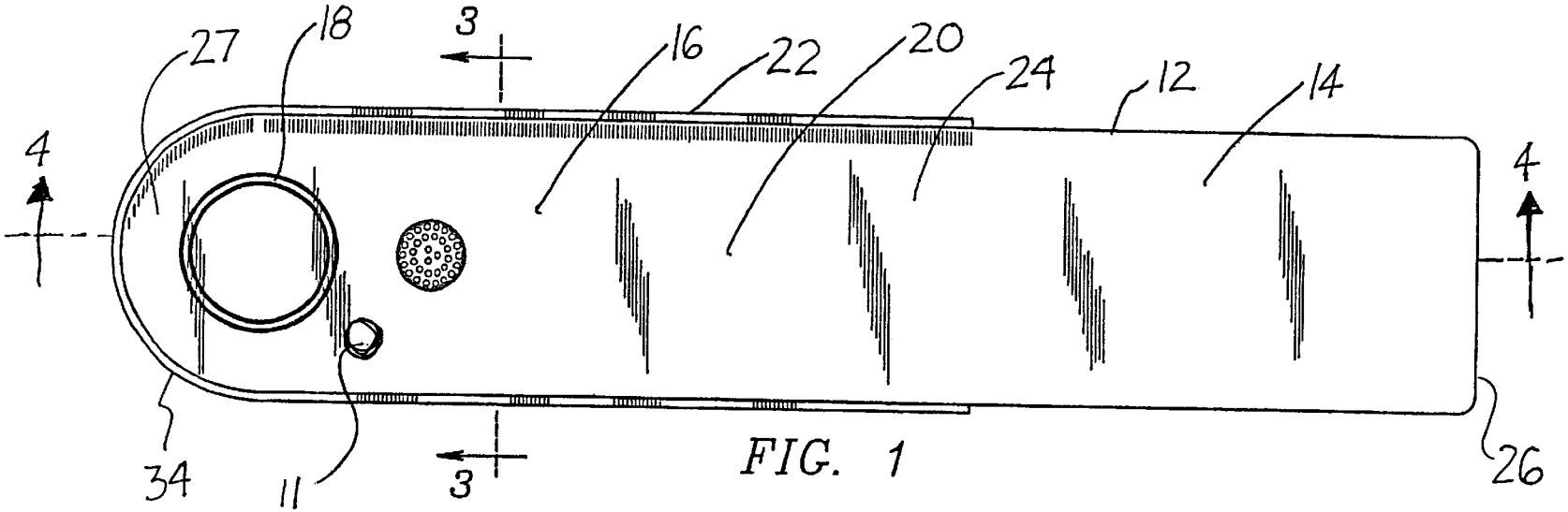
FIG. 1 is a top view of a new elevated golf putting practice device according to the present invention.

With reference now to the drawings, and in particular to FIGS. 1 through 7 thereof, a new elevated golf putting practice device embodying the principles and concepts of the present invention and generally designated by the reference numeral 10 will be described.

According to the invention there is provided a device for practicing propelling a ball, comprising a track, said track, when the device is in use, having a first end which adjoins a surface along which a ball is to travel and a second end which can be adjustably raised and lowered, relative to said first end, to incline the track, wherein, when the track is inclined, the first end of the track is such that a ball reaching said first end and traveling up said track incurs a minimum velocity loss and the second end has deflection means for directing the ball having traveled up said track and reached the second end, back down the track, wherein the track has a depression which is designed to catch a ball traveling up or down the incline within a desired target range, said depression having adjusting means to alter the depth of said depression.

The depression is positioned so that when a "perfect" strike of the ball is made which includes the aim, weight and/or speed of the ball, the ball is caught in the depression. The depression has the dimensions whereby the ball is retained in the depression but the ball can then be knocked out of the depression by causing another ball to impact against the retained ball. The depression is formed of an aperture which has a movable base forming the floor of the depression. The base can be moved up or down within the aperture and this movement will vary the depth of the depression. In a preferred embodiment, the base is formed of a main body to which is attached fixing means. The fixing means enables the base to be attached within the aperture on the main body of the device. The fixing means preferably comprises a screw type mechanism which can be connected to receiving means on the device, which are associated with the aperture. The extent to which the base is screwed into the receiving means of the device will dictate the depth of the depression. The more the base is screwed into the receiving means, the greater the depth of the depression. The depth of the depression can be selected in accordance with the angle of the incline to provide optimum levels of accuracy in aiming a ball on the device. The steeper the incline of the device then a greater depth of the depression is needed to retain a ball that is propelled along the device within the depression. Alternative fixing means may be used, such as, for example, a ratchet type fixing, slide mechanism, resilient attachment means. Alternatively the aperture, rather than having associated receiving means may have walls which form integral receiving means for the base. The base can also have integral attachment means on its outer periphery, for example, the aperture walls may have a screw thread which enables the base to be screwed into the aperture and again the depth by which the base is screwed into the aperture will dictate the depth of the depression. In a further embodiment, the attachment and receiving means may allow the floor of the depression to be tilted to a desired angle. In a further embodiment, the means may have an indicator element to show the depth of the depression and further this may be connected to a measuring device for measuring the incline of the device. This measuring device can then calculate the depth of depression needed to retain a ball based on the angle of the incline. It is envisaged that such a system could involve electronic means whereby on setting the incline, the depth of the depression is automatically adjusted to a depth whereby a ball will be retained in the depression. Alternatively, the depth of the depression can be used to set the incline of the device.

The depression is in the surface of the track and preferably is circular and has a depth of 4 mm. In another embodiment, targets may be placed in the depression which are shaped so that the target has a profile formed of raised and depressed areas. The profile is formed so that a ball traveling across the insert lodges on the insert. The inserts can be shaped to have a range of surface profiles for catching a ball such as a single line, a chevron/triangular shape, or a star shape comprising three or more arms. Alternatively, the target may comprise squares, polygons or circles concentrically arranged.

In a preferred embodiment of the invention, the device is manufactured of a flexible material such as plastic which has been moulded to form the device. It is envisaged that the device could also be made from other lightweight materials such as card, for example, laminated 1400 micron cardboard, and acrylic, fiber glass or polystyrene. Heavier materials can also be used, such as wood, or alternatively a metal such as steel. It is further envisaged that a combination of such materials could be used.

The device is preferably between 88 and 93 cms in length, although longer or shorter devices could be used according to the preference of the person using the device. However if the device is of a length which is too short, then the inclined slope of the track is not long enough to return the ball to the player, within the ideal putting range, which is in the region of between 90 and 900 cms (3 and 30 feet). A typical putting length required on a flat surface, such as a carpet is 450 cms (15 feet). The distance is a measurement which includes 12 feet to the leading edge of the device and then three feet along the length of the device. The return distance to the person hitting the ball is also 450 cms (15 feet).

The device preferably is in the form of a substantially rectangular plank, or alternatively it may be in the shape of a horseshoe. Further, the device may have at its first end, an opening which may be funnel shaped, and which may be adjustable to varying widths. The width of the funnel shaped opening may be varied according to the skill of the person aiming the ball. A wide opening could be used for inexperienced persons, who have poor aiming skills, while a narrower opening may be more preferable for persons required a higher degree of difficulty in aiming the ball.

The overall width of the device is preferably in the region of 33 cms, with the width of a channel traveling along the device being in the region of 12.5 cms although a range of widths could be used according to the skill of the player and the dimensions and type of ball that is being used. The funnel opening may be the same size as the width of the device or it may be narrower or wider than the width of the device and a typical width for the funnel opening lies in the range of 5 cms to 60 cms.

The track has a lead in area at its first end which in a preferred embodiment is curved or scooped. The lead in area of the track is adapted to reduce the drag co-efficient of the slope against a ball, thereby maintaining the forward momentum of the ball with a minimum loss of speed for the ball. In effect the ball travels onto the leading edge of the device with the same speed that it was traveling along the surface leading up to the device. This is achieved by providing a gradual transition angle at the lead in area of the device which forms the track having an incline. The lead in area of the device may be positioned at a range of angles, but a preferred angle is in the region of 8 to 26 degrees. As mentioned the lead in area may be shaped to have a scooped profile but alternatively, if the lead in area of the device, including the leading edge of the device, is of a narrow thickness, typically 1 to 5 mms, the weight of a ball passing over that material will cause the lead in area to bend, so forming in effect a scooped lead in area for the device.

The track may be held at an inclined angle by a single leg or brace, which is hinged relative to the track when inclined. Alternatively, a plurality of legs/braces may be used. Adjustment of the incline of the track is related to the degree of splay of the hinged leg and the hinged leg may be moved to an angle of 90 degrees relative to the inclined surface. The wider the splay of the leg the lower is the incline of the track. Alternatively, as is the case in a preferred embodiment, a telescoping leg is used to lift and support the raised end of the device. The telescoping leg has a series of steps and slots which interact thereby enabling the length of the leg to be adjusted and retained in the required position. If the telescoping leg is extended to its maximum then the track may be inclined at a relatively steep angle, while shortening the telescoping of the leg will reduce the angle of the incline relative to the surface on which it is resting.

The device according to the invention may be in the form of a pre-formed structure, however, in a further embodiment of the invention, the device may be demountable in that it may be collapsed and folded down, preferably to a size of approximately 33 cms by 31 cms, or more preferably to a size of approximately 21 cms by 31 cms and to a minimal thickness. This enables the device to be of a size such that it can be incorporated as a supplement within a publication such as a newspaper or a magazine, or alternatively the folded device may be incorporated with a promotional item connected with ball games. Alternatively the folded down device may form a cover, such as a wrap around cover for a magazine or promotional item.

The demountable structure comprises a piece of material forming the track to be inclined. At the end of the device which is the end that is to be raised or lowered, there are apertures or slots in the region of this end of the device. A further piece, or alternatively, pieces of material, form the deflector or backstop which is situated in the region of the end of the device which is to be raised or lowered. The piece or pieces forming the deflector have wings or tabs which may be inserted in apertures in the material forming the track. Once inserted in the apertures, the tabs or wings may be folded at an angle relative to the main body of material forming the deflector, thereby locking the material and track material together. If there are a number of pieces forming the deflector, these pieces may be interlocked with one another by using slits which receive a wall of an adjacent piece, thereby forming a deflector which is reinforced to withstand considerable impact by a ball. There are also apertures or slots that are situated in the end region of the device which is to be raised or lowered, which are adapted to receive a further piece or pieces of material, forming the brace, hinged leg or telescoping leg, which is to support the track in its inclined position. To collapse or demount the device the tabs/wings may be straightened so that they may be removed from the apertures of the track and the whole structure may be collapsed and folded. Alternatively, the tabs/wings may be integral with the surface forming the track and the apertures may be in the pieces forming the support and/or back-stop. In a further embodiment the back-stop and the support for the track may be combined as a unitary part of the device. In this embodiment the support has a top piece which may be pushed through apertures in the track. The upper part of the support has fold lines and slits. The folds allow the pieces which are to form the back-stop to be folded into tabs/wings while the slits allow the tabs/wings which are formed to be interlocked with one another to form the backstop. The lower part of the support will rest on the floor and holds the track at an incline. The lower part may also have slits which enable the support to be interlocked with further pieces of material to form a larger support which produces a steeper incline for the track.

The device may have a slit running up the length of the surface forming the inclined track, from the first end towards the second end of the track. The slit preferably runs along the center area of the length of the surface forming the track. Areas of the material in proximity to this slit may be folded to form a raised edge thereby providing a center partition for track of the device. This partition in effect defines separate channels for a ball traveling up and then down the device. Further fold lines in proximity to the outside edge of the track enable the outside edges of the surface to be folded upwards in order to form guide walls for preventing a ball from rolling off the track. Further the surface forming the track may have recesses for receiving a ball traveling over the track.

In greater detail with reference to the drawings, the present invention, designated as numeral 10, includes a base 12 having a bottom portion 14 with a substantially planar rectangular configuration defined by a short linear bottom edge and a pair of elongated linear side edges. The base further includes a top portion with a substantially planar rectangular configuration defined by a short semicircular top edge, a pair of elongated side edges, and a short linear bottom edge. Such bottom edge of the top portion is integrally coupled to a short linear top edge of the bottom portion and resides in a plane which forms an obtuse angle with respect to that in which the bottom portion resides. In the alternative, the top portion and the bottom portion may reside in coplanar relationship. The base ideally has a length of about 90 cm and a width of 33 cm.

Figure 4:
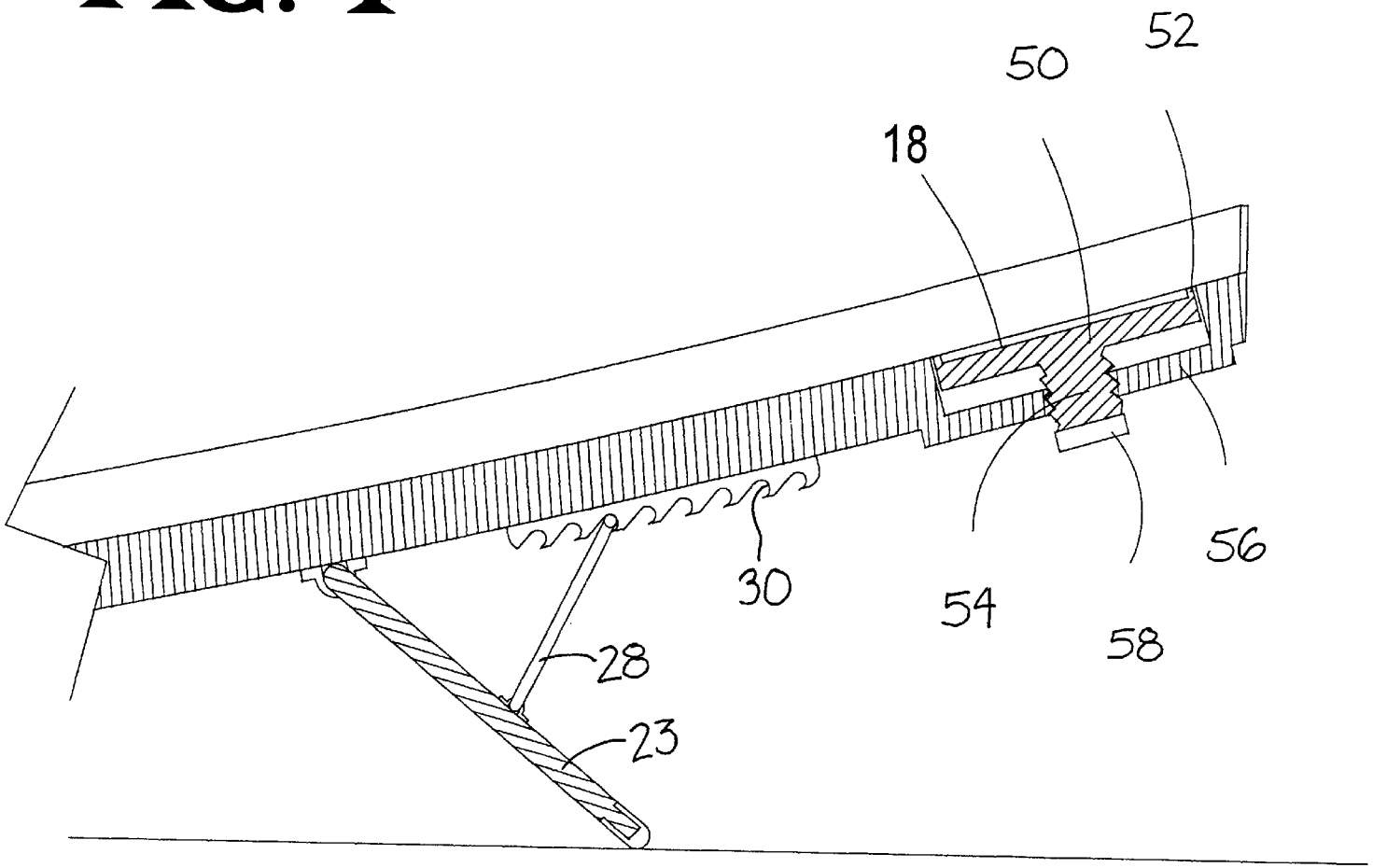
FIG. 4 is a cross-sectional view of the present invention taken along line 4—4 shown in FIG. 1.

Situated on the top portion of the base is a circular target 18. As shown in FIG. 4, the target includes a circular top plate 50 having a peripheral lip 52 integrally coupled thereto and extending upwardly therefrom. Integrally coupled to a central extent of a bottom surface of the top plate is a threaded post 54 which threadedly engages a threaded bore formed in a well 56 that is formed in the base. Ideally, a bottom end of the threaded post has a groove 58 formed therein for receiving a screwdriver or the like to facilitate raising and lowering of the target. Positioned below and to the side of the target is a semi-circular divot, or stimp meter 60. The stimp meter is used to test the speed of the putting surface by placing a ball within the divot and increasingly angling the base until the ball is urged out of the divot. The distance the ball rolls gives the indication of the speed of the putting surface.

Lining an entire surface of the top portion and the bottom portion of the base is a felt material 20. Further, a recess defining peripheral lip 22 is coupled to the top edge and side edges of the top portion of the base and extends upwardly therefrom. Ideally, such recess is 4 mm. Terminal ends of the peripheral lip preferably terminate adjacent to the intersection of the top and bottom portion of the base and further taper.

Finally, a leg 23 is equipped with a substantially planar configuration defined by a linear top edge coupled between the side edges of the top portion of the base at a midpoint thereof and in perpendicular relationship therewith. As shown in FIG. 3, the leg is further defined by a pair of linear side edges and a semicircular bottom edge to define a pair of pointed feet for abutting a ground surface In use, the leg resides within a plane which forms about a 45 degree angle with a plane in which the top portion of the base resides. Note FIG. 2. Ideally, the leg is adjustable by the means shown in FIG. 4. As shown, the leg has an inverted U-shaped bar 28 pivotally coupled to a central extent thereof. This U-shaped bar has a top bar which is adapted to releasably engage one of a plurality of teeth formed in the bottom surface of the base, thereby allowing selective angling of the base. In various alternate embodiments, the leg may replaced by any type of adjustable support including a pair telescoping support posts.

In operation, the present invention may be used to practice putting skills. The method associated with the operation of the present invention first entails the step of providing the components set forth hereinabove. Next, a user strikes a first golf ball to impart motion on the same such that the first golf ball travels up the base to the target area. The object while striking the first golf ball is to impart motion with a force that is sufficient enough to allow the first golf ball to remain within the recess of the target area. It should be noted that such force is dependent on the selected angle of the base and the depth of the recess of the target. For example, when the recess is selected to be shallow, it is imperative that the force be precise enough to place the ball just above a lower portion of the peripheral lip of the target. It is thus apparent that if the ball moves past the lower portion of the peripheral lip of the target an excessive distance, it will gain too much downward momentum and leave the recess, especially when the recess is shallow. Once the first ball is successfully maintained within the recess, the user then strikes a second golf ball to impart motion on the same such that the second golf ball travels up the base to strike the first golf ball with force sufficient to dislodge the first golf ball from the target area. Both golf balls are thus allowed to travel down the base.

It can be seen from FIG. 1 that the device when erected, comprises a track having an inclined surface 24 with a first end 26 having a lead in area with an edge which rests on a surface along which a ball travels. A second end 27 of the track is raised relative to the first end and the second end is supported by a leg or brace 23 which is locked selectively in position by a rod 28 having an end which is insertable into a selected one of apertures 30 on the edge of the inclined surface. If the end of the rod is removed from an aperture the device may be folded down to provide a flat, easily transportable and storable structure. As can be seen from FIG. 2, the first end and leading edge of the inclined surface, is very thin and slightly scooped.

Figure 2:
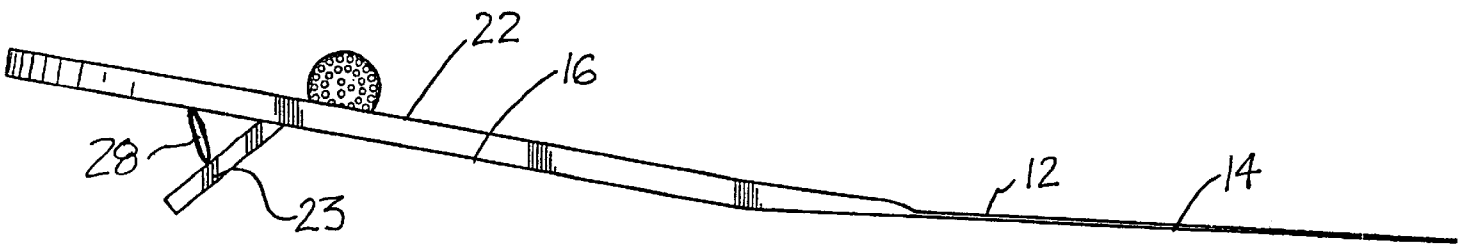
FIG. 2 is a side view of the present invention.
Figure 3:
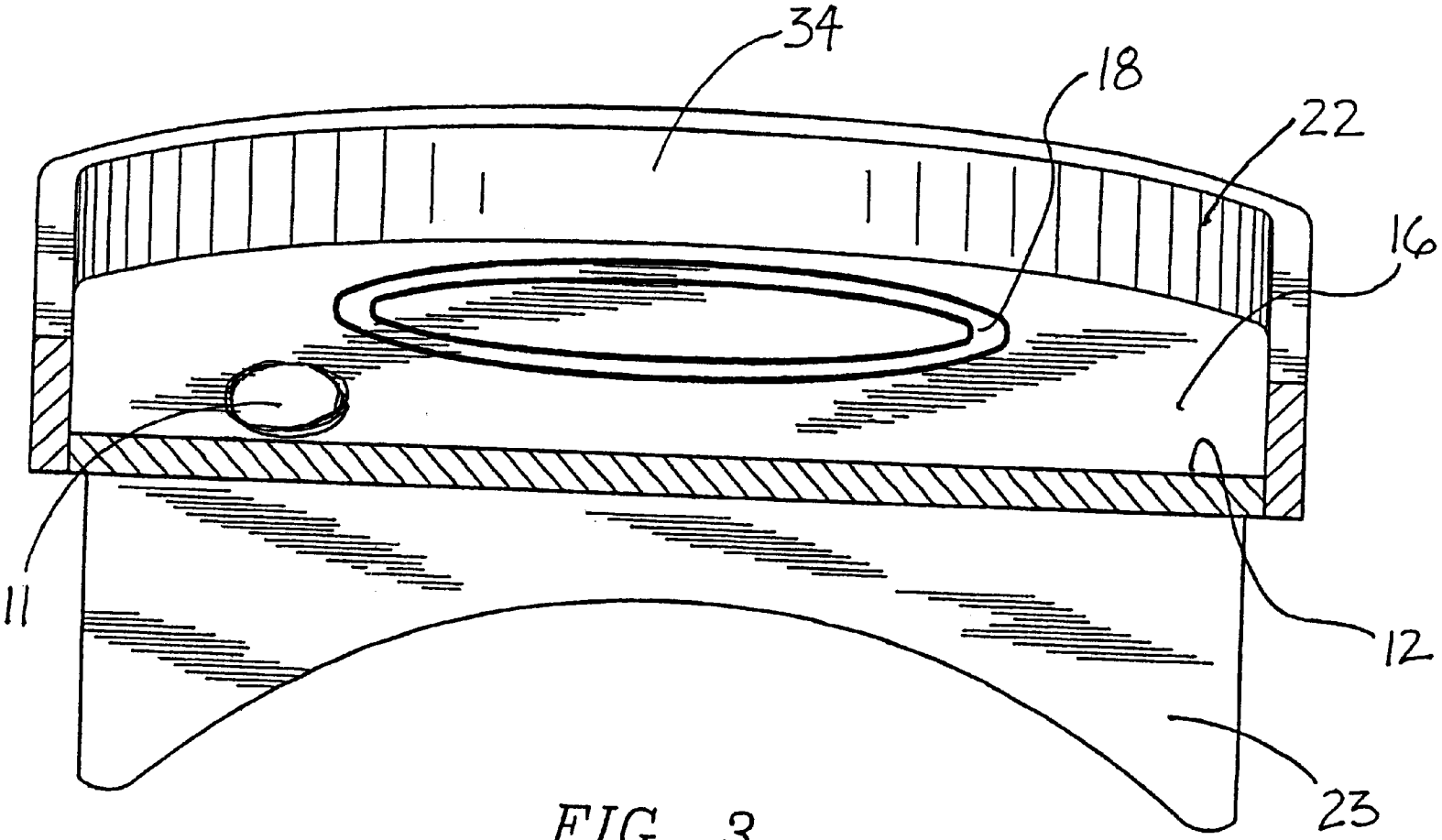
FIG. 3 is a cross-sectional view of the present invention taken along line 3—3 shown in FIG. 1.

FIGS. 2 and 3 show a plank type device with an inclined surface and around the inclined surface there is a raised edging member 32, which prevents a ball from rolling off the inclined surface. As an alternative to, or in combination with the raised edging member, there may be routed channels which form a depression which prevents a ball from falling off the back or the edge of the device. The member 32 also assists in directed the ball back toward the feet of a person aiming the ball, once the ball has hit the back-stop wall (or deflector) area 34 of the device. A device of this type may also have a depression 19 at the target 18 for holding a ball that is aimed at the device. Also there may be a recess such as shown at 11 for holding a ball positioned by the player on the device.

Figure 5:
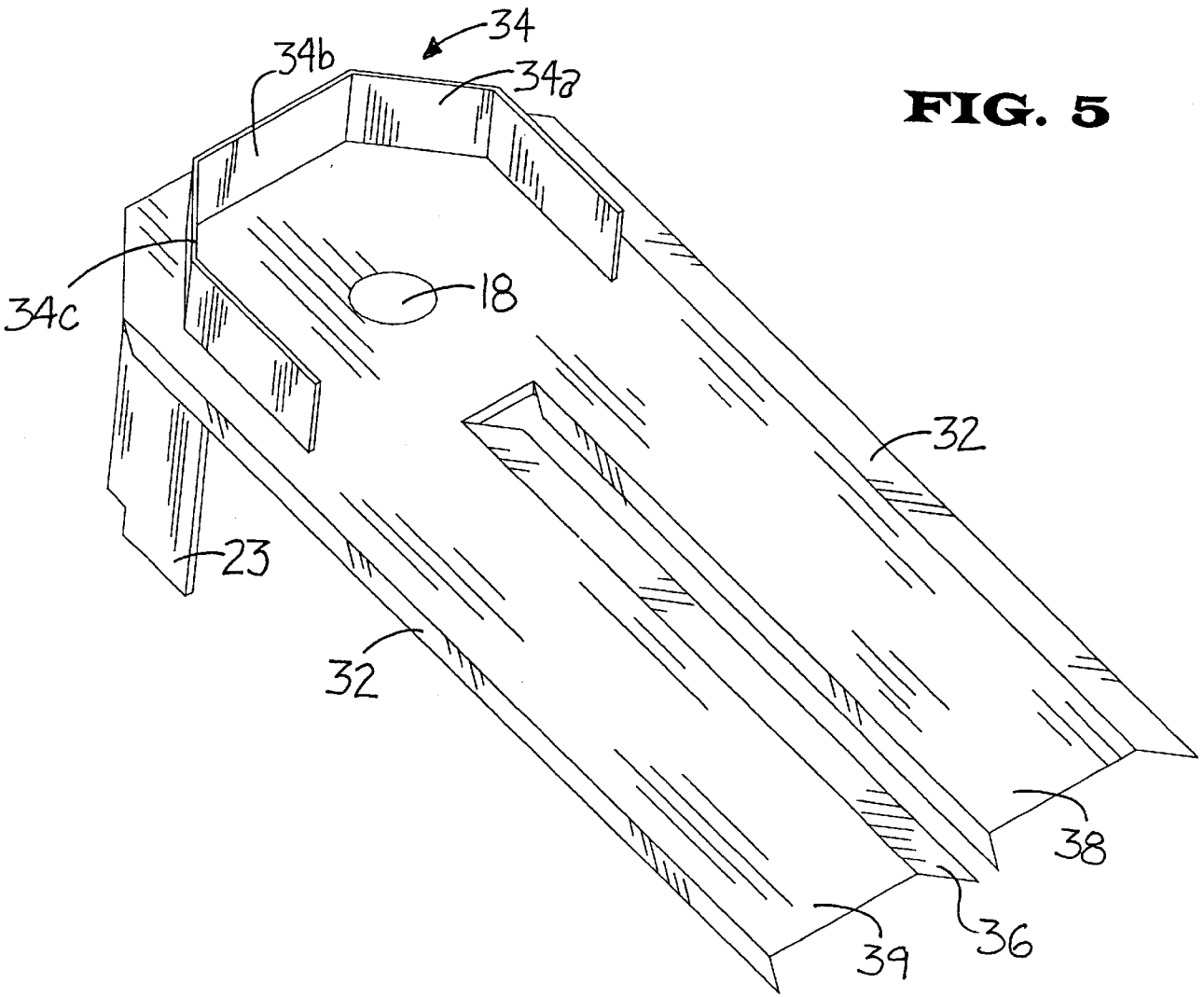
FIG. 5 is a perspective view of an optional variation of the golf putting practice device of the present invention.

FIG. 5 shows a version of the device which is demountable. In this version of the device, edging member 32, wall 34 which acts as a back-stop and ball return area and partition wall 36 form defined channels. Channel 38 is the channel used for guiding the ball up the incline, while channel 39 is the channel which the ball follows once it has hit the wall 34. The wall 34 is of a substantially semicircular shape and in particular comprises a number of parts, preferably 3, which are angled to one another to form the wall 34. The wall 34 is angled so that the ball traveling up channel 38, is in effect directed from part 34*a* to part 34*b* and then to part 34*c* of wall 34 before rolling down channel 39. The raised end of the device having wall 34 may have a slope or camber of between 1 and 4 degrees and preferably 2 degrees, towards channel 39, to assist the ball which hits the parts of the wall 34, to roll down the return channel 1*c* by means of a velodrome effect. In an alternative embodiment, the raised end of the device, rather than having a slope or camber, which enables the ball to roll from the upward channel to the downward channel, may be substantially level. However when the end of the raised device is level, the channels are spayed and this provides a difference in length between the edging wall 32 and inner wall 36 so producing the velodrome effect which causes the ball to travel from channel 38 around the end of the device which is edged by wall 34 and down channel 39. A perfect aim of the ball, is when the ball travels up channel 38 and lands in the depression 19. A further ball may then be aimed at the device and it will travel up the device and reach the ball held in the depression 19. A "perfect put" is when the second ball knocks the first ball out of the depression 19 and both balls then roll down the inclined part of the device, without hitting wall 34 and the ball then rolls down channel 39 and towards the person aiming the ball and lands at their feet with an error margin of +/−15 cms of accuracy.

The backstop wall 34 and the brace 23 are attached to the inclined surface by interlocking tabs. The pieces 34*a*, 34*b* and 34*c*, forming the backstop wall may have slits which run from a surface which is parallel to said surface adjoining the plane. The pieces may be fastened to each by sliding a slitted area of one piece into the slitted area of an adjacent piece, thereby interlocking the pieces together to form a substantially rigid back wall 34. Internal divider wall 36 is folded so that its edges meet to form a V-shaped divider between the channels 38 and 39. At the end of the divider wall 36 nearest to the wall 34, there is target area which is the area that a person aims to reach when propelling the ball. The collapsible/demountable device may further include strengthening means comprising pieces of material which are inserted between interlocking pieces parts having fold lines to provide added strength to the device. Alternatively, the strengthening pieces may be attached to the device either by interlocking with the device, by being push fitted on to the device or by being adhered to the device.

Figure 6:
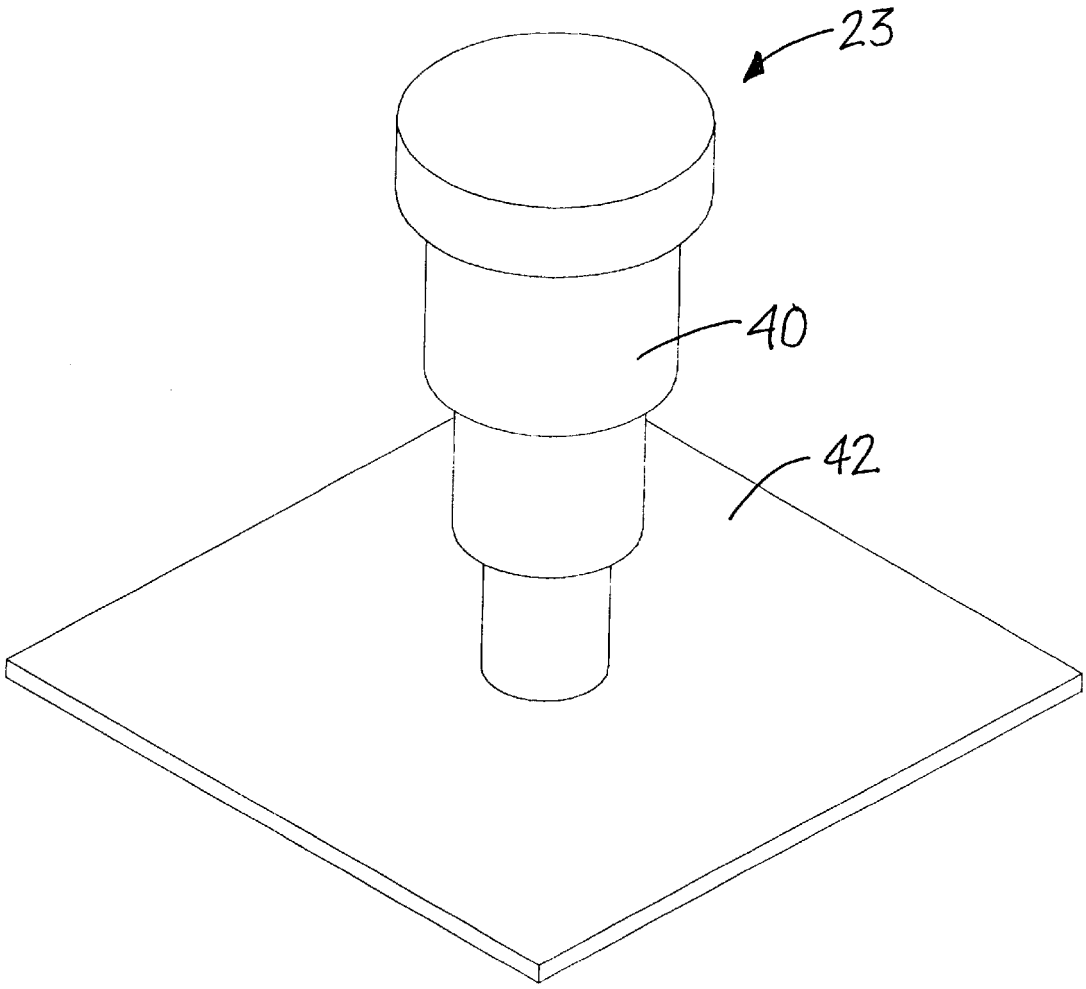
FIG. 6 is a perspective view of a telescoping support for the base of the present invention shown isolated from the base.

FIG. 6 shows an alternative means for supporting the inclined surface. Instead of a hinged bracket, a telescoping rod 40, having a plate member 42 for maintaining the stability of the device, may be used which is adjusted according to the angle which is required for the inclined surface.

Figure 7:
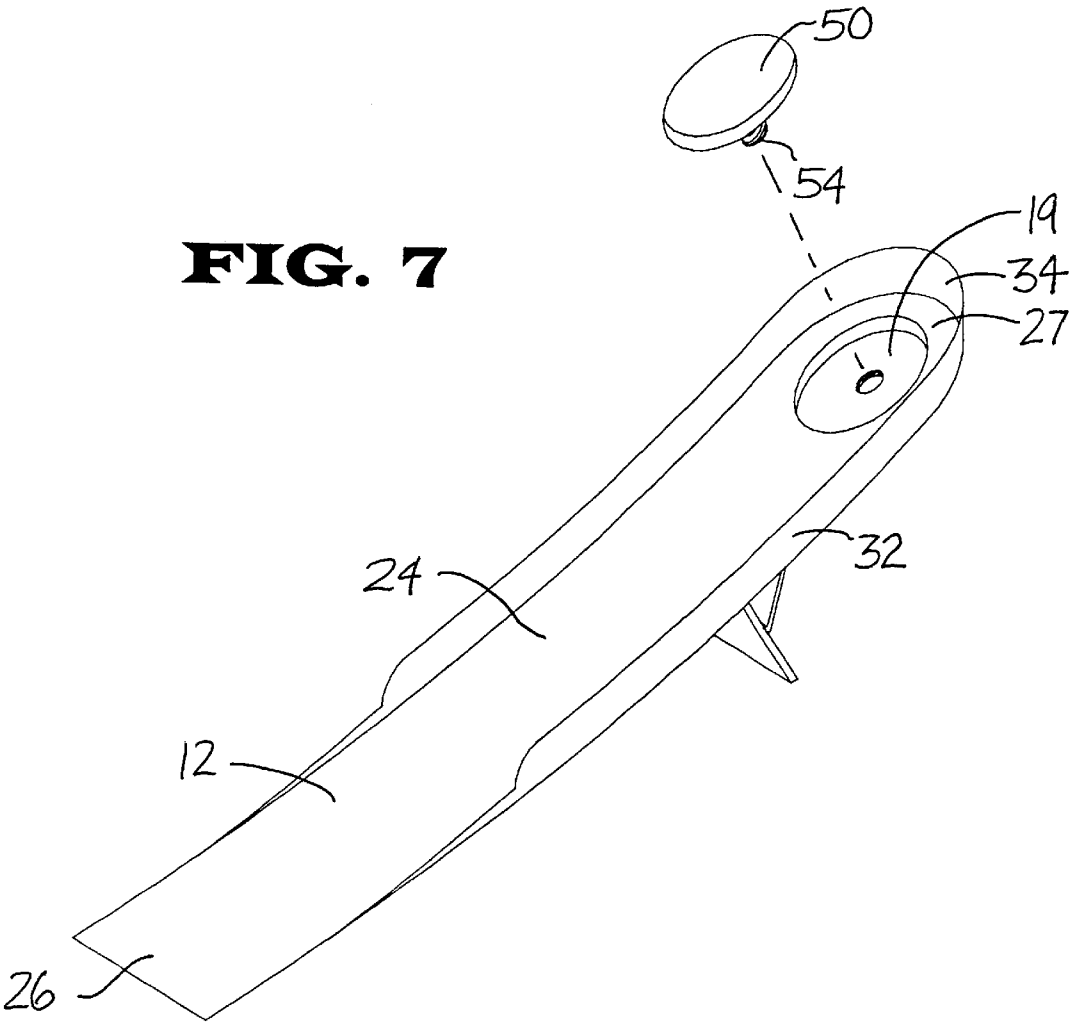
FIG. 7 is a perspective view of the embodiment of the invention shown in FIG. 4.

FIG. 7 shows a plank type device as shown in FIG. 4 having a depression 19 for catching a ball. The depression is circular and preferably of 4 mm depth. A further ball may then be aimed at the retained ball to knock the first ball out of the depression and the slope of the device will then enable the balls to be returned to, the feet of the player. The depression 19 is formed of an aperture 21 having receiving means 20. The receiving means enable fixing means 54 attached to a base plate 50 forming the floor of the depression 19, to be attached to the device 1.

In alternative embodiments of this type of device the base may be fixed to means within the aperture by ratchet means, resilient means, spring loaded means or pin means. It is also feasible that there could be electronic means for positioning the base within the aperture. Also, electronic means may be attached to the device to indicate the incline of the slope and show the optimum depth of depression needed to retain a ball aimed at the device.

A ball traveling up the device which has been aimed and weighted perfectly, will lodge in the depression. The depth of the depression is such that the ball is just held in the depression without rolling out. This is achieved by the depression having a clearly defined edge which cases the ball to immediately drop into the depression. The momentum of the ball is lost and the ball remains in the depression. When the ball is sat in the depression it can act as a level indicator for the device. If the ball sits to one side of the depression, this indicates that the device is leaning in the direction that the ball is sitting and so device may then be positioned to correct the lean. A further ball may be aimed at the ball in the depression so as to knock the retained ball out and this will then roll down the track and towards the feet of the person propelling the ball.

The device may also act as a device for testing the speed of a surface such as a green or a carpet and comparing it with known speeds for such surfaces. The device includes a recess 11 into which a ball may be placed. The recess is 2 cms in diameter if the recess is rounded, or alternatively if the recess is of a rectilinear shape such as a square or rectangle, the dimensions of the recess are 2 by 1.8 cms. Further ideally, the recess is 79.5 cms from the leading edge of the device. The device may then be tilted so that the ball rolls out of the recess down the side of the incline. The distance the ball travels from the device is used to calculate the speed of the surface along which the ball traveled. Typically the speed of the surface can be gauged as follows:

| | Distance traveled on a green (ms) | | | | | | |
|---|---|---|---|---|---|---|---|
| | Slow | | | Medium | | Very fast | |
| | 2.4 | 2.73 | 3.03 | 3.33 | 3.64 | 3.94 | 4.24 |
| (feet) | 8 | 9 | 10 | 11 | 12 | 13 | 14 |

Further embodiments of the invention are a device molded from clear acrylic. Such a device has a molded scooped front end and a tripod like adjustable stand at the second end for adjusting the height of the incline. The legs of the tripod stand can be slotted into pre-formed holes in the inclined surface. The device may also include a built in level checking means such as a spirit level so that a player may check whether the device itself is substantially level or is on a substantially flat surface. If a plastic device is used the spirit level can be moulded as an integral part of the device. Further a surface such as a carpet or baize may be attached to the lead-in edge of the device to provide surface with differing resistances which will determine the speed at which the all approaches the device. A surface with no pile will provide a fast approach while a deep pile will slow the ball down as it approaches the device.

Also, the device may have a more convoluted path. Instead of having a simple path traveling up and down the incline, there may be a number of paths which may branch off each other and which feed to a center point of the device. Such a device would encourage a person to increase the strength of their aim as the velocity at which the ball hits the device would determine whether the ball hits the center point or not.

Further refinements could involve covering the paths of the device with felt to minimize impact noise and digital sensors and indicators on the device to give details of the accuracy of aiming of the ball, the speed and the direction in which the ball is traveling.

Although the device has been described with particular reference to aiming a golf ball it is envisaged that the device could be used for practicing aiming a ball for other ball games such as football, crown green or lawn bowls, cricket, ten pin bowling or hockey.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf putting practice device comprising, in combination:

a base including a bottom portion with a substantially planar rectangular configuration defined by a short linear bottom edge and a pair of elongated linear side edges and a top portion with a substantially planar rectangular configuration defined by a short semicircular top edge, a pair of elongated side edges, and a short linear bottom edge integrally coupled to a short linear top edge of the bottom portion;

a target situated on the top portion of the base adjacent to the top edge thereof and in coaxial relationship with a circle defined by the top edge of the top portion of the base, the target including a top plate having a peripheral lip integrally coupled thereto and extending upwardly therefrom and a threaded post threadedly engaging a threaded bore formed in a well that is positioned in the base;

a divot formed in the top portion of the base below the target;

a peripheral lip coupled to the top edge and side edges of the top portion of the base and extending upwardly therefrom; and a leg with a substantially planar configuration defined by a linear top edge coupled between the side edges of the top portion of the base at a midpoint thereof and in perpendicular relationship therewith, a pair of linear side edges, and a bottom edge to define at least one foot for abutting a ground surface.

2. A device for practicing propelling a ball, comprising:

a track having a first end for adjoining a surface along which a ball is to travel when the device is in use, the track having a second end and an upper surface between the first and second ends;

positioning means for adjustably raising and lowering a position of the second end of the track with respect to the first end of the track to thereby adjust an incline of the upper surface of the track between the first and second ends;

deflection means at the second end of the track for directing the ball back down the track after having traveled along the upper surface of the track and reached the second end;

a depression formed in the track for catching a ball traveling up or down the upper surface of the track; and adjusting means for altering a depth of the depression with respect to the upper surface of the track, the adjusting means being adjustable to a plurality of different depth settings with a range of depth settings for permitting adjustment of a depth of the depression to a desired depth;

wherein the adjusting means includes a screw mechanism permitting adjustment to a substantially infinite number of different depth settings within the range of depth settings, the screw mechanism holding and remaining at a selected depth setting between adjustments of the adjustment means.

3. A device for practicing propelling a ball, comprising:

a track having a first end for adjoining a surface along which a ball is to travel when the device is in use, the track having a second end and an upper surface between the first and second ends;

positioning means for adjustably raising and lowering a position of the second end of the track with, respect to the first end of the track to thereby adjust an incline of the upper surface of the track between the first and second ends;

deflection means at the second end of the track for directing the ball back down the track after having traveled along the upper surface of the track and reached the second end;

a depression formed in the track for catching a ball traveling up or down the upper surface of the track; and adjusting means for altering a depth of the depression with respect to the upper surface of the track, the adjusting means being adjustable to a plurality of different depth settings with a range of depth settings for permitting adjustment of a depth of the depression to a desired depth;

wherein the depression comprises an aperture, and a base member is received in the aperture to form a floor of the depression;

wherein the base member includes a plate and a post extending from the plate, a portion of the post being threaded, and wherein the depression comprises a well formed in the track, the well having a threaded bore formed therein, the post being threaded into the bore for permitting rotation of the base member with respect to the track such that a position of the post in the bore is changed by rotation of the post.

* * * * *